United States Patent [19]

Ladd

[11] Patent Number: 4,912,457

[45] Date of Patent: Mar. 27, 1990

[54] DETECTOR AND MESSAGE ANNUNCIATOR DEVICE

[75] Inventor: Howard P. Ladd, Los Angeles, Calif.

[73] Assignee: Ladd Electronics

[21] Appl. No.: 287,878

[22] Filed: Dec. 21, 1988

[51] Int. Cl.[4] ..... G08B 23/00

[52] U.S. Cl. ..... 340/573; 340/692

[58] Field of Search ..... 340/573, 567, 692, 528; 40/463–465, 902; 360/12

[56] References Cited

U.S. PATENT DOCUMENTS

| | | | |
|---|---|---|---|
| 3,594,760 | 7/1971 | Haker | 40/464 X |
| 4,358,754 | 11/1982 | Young et al. | 40/463 X |
| 4,560,978 | 12/1985 | Lemelson | 340/692 X |
| 4,682,348 | 7/1987 | Dawson et al. | 340/692 X |
| 4,703,312 | 10/1987 | Berry, III | 340/692 X |
| 4,709,330 | 11/1987 | Yokoi et al. | 340/573 X |
| 4,754,266 | 6/1988 | Shand et al. | 340/692 X |

*Primary Examiner*—Joseph A. Orsino
*Assistant Examiner*—Thomas J. Mullen, Jr.
*Attorney, Agent, or Firm*—Blakely, Sokoloff, Taylor & Zafman

[57] ABSTRACT

An apparatus for detecting the presence of people and generating an audio message and/or a video display directed to the person or persons whose presence has been detected. Message delivery is focused since the message is intended only for persons in the immediate vicinity of the subject of the message, and message repetition must be controlled to avoid constant repeating of the message during periods of high traffic. The invented apparatus implements the foregoing requirements by the use of a passive infra-red detector with a variable range control adjustable from approximately two feet to ten feet to preclude detection outside of an immediate, focused vicinity. In one embodiment, an EPROM message cartridge which may be plugged into the unit is used to store a message. The cartridges are removable so that they may be rerecorded using standard EPROM programming techniques. Alternatively, the recording medium may be built into the apparatus. Additionally, an annunciator variable pause interval timer is used to provide a preselected and adjustable pause between annunciated messages so that triggering of the message is inhibited during that pause.

17 Claims, 2 Drawing Sheets

DETECTOR AND MESSAGE ANNUNCIATOR DEVICE

SUMMARY OF THE INVENTION

The present invention is directed to an apparatus for detecting the presence of people and generating an audio message and/or a video display directed to the person or persons whose presence has been detected. The invented apparatus has application as a point of sale or point of product advertising message to inform customers of the advantages or features of a particular product on display. Other potential applications include usage in industrial or other areas where it is desired to have a safety or warning message, for example, to remind machine tool operators to use safety guards on machinery or to wear protective clothing and the like. Another use is in the area of security to detect intruders and warn away the intruder. Similar applications exist in hospitals, laboratories or wherever safety, security or health can be aided by the use of an audio and/or visual message which plays whenever personnel enter a predetermined area.

Message delivery must be focused since the message is intended only for persons in the immediate vicinity of the subject of the message, and message repetition must be controlled to avoid constant repeating of the message during periods of high traffic. Additionally, the apparatus has the capability of having its message changed quickly and easily and yet also be tamper proof.

The invented apparatus implements the foregoing requirements by the use of a passive infra-red detector with a variable range control adjustable from approximately two feet to ten feet to preclude detection outside of an immediate, focused vicinity. In one embodiment, an EPROM message cartridge which may be plugged into the unit is used to store a message. The cartridges are removable so that they may be rerecorded using standard EPROM programming techniques. Alternatively, the recording medium may be built into the apparatus. Additionally, an annunciator variable pause interval timer is used to provide a preselected and adjustable pause between annunciated messages so that triggering of the message is inhibited during that pause.

DETAILED DESCRIPTION OF THE INVENTION

Figure 1:
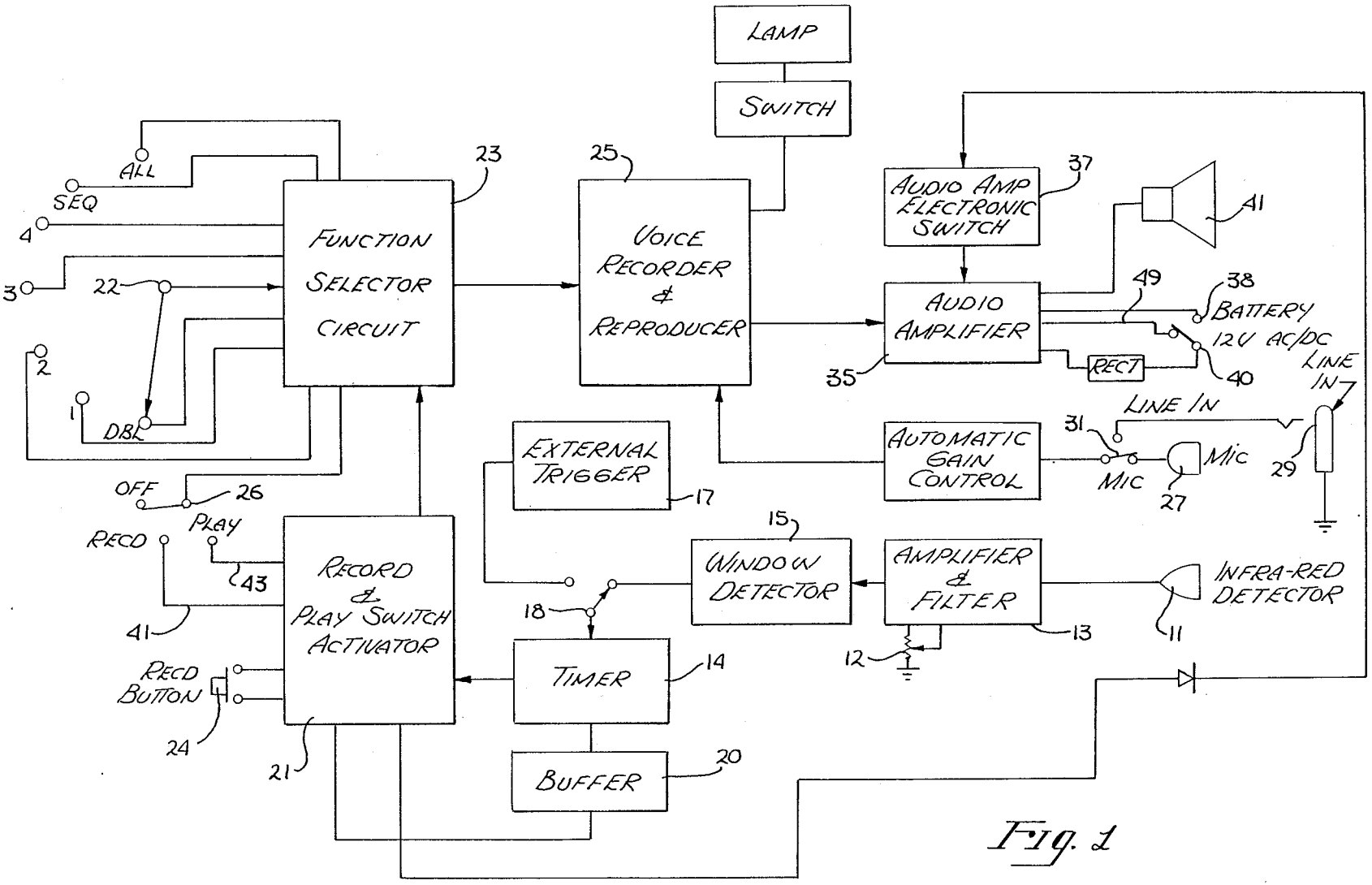
FIG. 1 is a functional block diagram of the invented apparatus.

FIG. 1 illustrates a functional block diagram showing the various elements of the invented apparatus. Specifically, an infra-red detector 11 is coupled through an amplifier and filter 13 to window detector 15 which generates a signal indicating that a person has come within the range of the device. Alternatively, an external trigger 17 may be used to activate message annunciation. A signal from window detector 15 or external trigger 17, selectable by switch 18, is input to timer 19 which is set to provide a delay so that successive triggers from detector 11 do not cause immediate repetition of the message. The output of timer 19 is passed through buffer 20 which converts a high impedance signal to a low impedance signal. In this manner, if a trigger signal comes in while timer 19 is cycling, that signal is ignored, otherwise a signal is sent by buffer 20 to record and play switch activator logic 21 which controls function selector circuit 23. Function selector circuit 23 generates codes which are input to voice recorder and reproduction circuit 25 which records or plays back voice announcements based upon the position of switch 26. Announcements are stored in voice recorder and reproduction circuit 25 by input from microphone 27 or line input 29 based upon the position of switch 31. The audio signal from line input 29 or microphone 27 is input to automatic gain control 33 which provides an audio output for storage in voice recorder and reproduction circuit 25. When in play back mode, the stored announcement is output from voice recorder and reproduction circuit 25 to audio amplifier 35. Audio amplifier electronic switch 37 turns power to audio amplifier 35 on whenever a trigger signal is input to record and play switch activator 21. Audio amplifier 35 drives speaker 41 which produces an audible message.

Power is supplied by a battery 38 or AC or DC line input 40. If battery power is used, a signal on line 49 turns audio amplifier 35 off which reduces power consumption at the expense of a lower level output from speaker 41.

In an alternate embodiment, instead of or in addition to voice recorder and reproducer 25, a transparency viewer may be turned on when a trigger is received. In this alternate embodiment, a signal, such as one generated by voice recorder and reproducer 25 when a trigger is detected, activates a transistor switch 52 which lights a lamp 54 which is used to illuminate a transparency viewer.

With the foregoing overview in mind, details concerning the various functional blocks which comprise the invention will now be set forth. In this connection, details such as power lines and control signals will be set forth only as may be necessary for a proper understanding of the invention since the specific details will be apparent to persons having ordinary skill in electronic circuit design. In other instances, functional blocks which may be implemented by well known circuits will be described only to the extent necessary to instruct a person of ordinary skill in the art how such functional block may be implemented.

Infra-red detector 11 produces an output voltage proportional to filtered infra-red energy which it detects. In one embodiment, a passive infra-red detector with a single lithium tantalate sensing element is used such as a #408 available from Eltec Corp. The detector should have an infrared band filter centered around a wavelength of 9.5 microns which is the wavelength generated by human beings.

Amplifier and filter 13 may be implemented by two operational amplifiers which are connected to select a frequency band from 0.6 Hz to 16 Hz and then amplify that band by about 70 dB. Amplifier and filter may include a potentiometer 12 coupled to one terminal of infra-red detector 11 to adjust the sensitivity of the detector, with a typical range of detection being between two and ten feet.

Window detector 15 allows only voltages above 1 and below 3 volts to pass to eliminate spurious signals which may be generated by infra-red detector 11. Window detector 15 may be implemented by, for example, the use of 3 voltage comparators arranged to pass only voltages above 1 volt and below 3 volts.

External trigger 17 may be any external circuitry capable of generating a ground signal to activate message annunciation in lieu of a signal generated by infra-red detector 11.

Switch 18 is used to select between inputs from external trigger 17 and window detector 15, and may be implemented by, for example, a plug jack which automatically disconnects the signal generated by infra-red detector 11 when a plug from external trigger 17 is inserted. The signal from external trigger 17 is used whenever it is necessary to generate a message without the use of infra-red detector 11 such as to enable a customer who desires to hear a message repeated by pressing a button.

Timer 19 may be implemented as a timer capable of generating a TTL control signal. Preferably, the timer should be adjustable with a range of for example 10 seconds to three minutes being adequate for most applications.

Whenever a signal between 1 and 3 volts is received by buffer 20 from window detector 15 or trigger 17, buffer 20 generates a logic 1 which is input to record and play switch activator 21 after a predetermined time specified by timer 19. When voltage outside the range 1–3 volts is received by buffer 20, a logic 0 is sent to record and play switch activator 21. Buffer 20 may be implemented as a transistor switch, the specific details of which would be obvious to a person having ordinary skill in the art. The logic 1 or 0 input to record and play switch activator 21 is output by record and play switch activator 21 to audio amplifier electronic switch 37.

The details concerning record and play switch activator 21, function select circuit 23 and voice recorder and reproducer 25 will be described below with reference to FIG. 2.

Automatic gain control 33 provides automatic record level control as follows. Audio signal feedback is output from voice recorder and reproducer 25 to automatic gain control 33. This voltage is AC coupled to rectifier diodes and filter elements which convert the audio signal to a positive DC voltage which is then applied to a current converter and a controllable impedance which varies inversely with the amplitude of the feedback signal. The audio input is attenuated by the ratio of a resistance to the controllable impedance resulting in a relatively constant recording amplitude necessary for better message quality. The specific circuit details to provide automatic record level control are well known in the art and, therefore, need not be set forth herein.

Audio amplifier 35 is a standard audio amplifier circuit which which is capable of amplifying an analog audio signal from voice reproducer 25 to drive speaker 41.

Electronic switch 37, based upon a signal from record and play switch actuator 21, turns power to amplifier 35 on or off to conserve power when no message is being played back. The specific circuit details should be apparent to a person skilled in the relevant art.

Record and play switch actuator 21, in addition to the signal from buffer 20, receives as inputs a record signal 41 or play signal 43 from function selector circuit 23 according to the position of switch 26. Additionally, a record button 24 must be pressed when the record signal is received from function selector circuit 23 if it is desired to record sounds generated by microphone 27 or line input 29, as applicable. Record button 24 is needed to initiate recording once the record signal 41 is generated by function selector circuit 23. The manner in which recorded messages are played back is determined by the position of selector switch 22 and is described in detail below.

Message recording is flexible and provides a variety of message recording modes. In particular, switch 22 and function selector circuit 23 provide seven message modes as follows. Up to four messages may be recorded in four separate channels. Message 1 is selected by placing switch 22 in position 1. Similarly, message 2, 3 or 4 is selected by placing switch 22 in position 2, 3 or 4, respectively. When in playback mode, the channel or channels which are played is determined by the position of switch 22. In positions 1, 2, 3 or 4, the message recorded in channel 1, 2, 3 or 4 respectively is played back. In position ALL, all four channels will be played sequentially with each trigger. In position SEQ, the messages in channels 1–4 will be played back in sequence, with the message in one of channels 2–4 played back as a result of each trigger. In position DBL, a double length message will be played back using the message recorded in a double channel which may overlap any two of channels 1–4. Typically, each channel stores 16 seconds of audio data, but the message length is a function of the amount of memory (RAM) used and may be greater or less than 16 seconds. If the double channel is used, the length of the message is doubled. If switch 22 is in the ALL position, the length of the message is quadrupled.

The foregoing discussion assumes that the apparatus has recording capabilities. However, as will be explained below, while the preferred embodiment has recording capability, such capability is not needed to practice the invention since desired messages may be prerecorded in an EPROM which is mounted in a cartridge for playback using a speech synthesizer such as a T6668 available from Toshiba Electric. The differences which would need to be made to the circuitry described below to accomodate such a cartridge will be apparent to persons skilled in the art.

The operation and specific implementation details of the record and play switch activator circuit 21, function selector circuit 23 and voice recorder and reproducer circuit 25 will now be described with reference to FIG. 2 which is a detailed block diagram of such elements.

Figure 2:
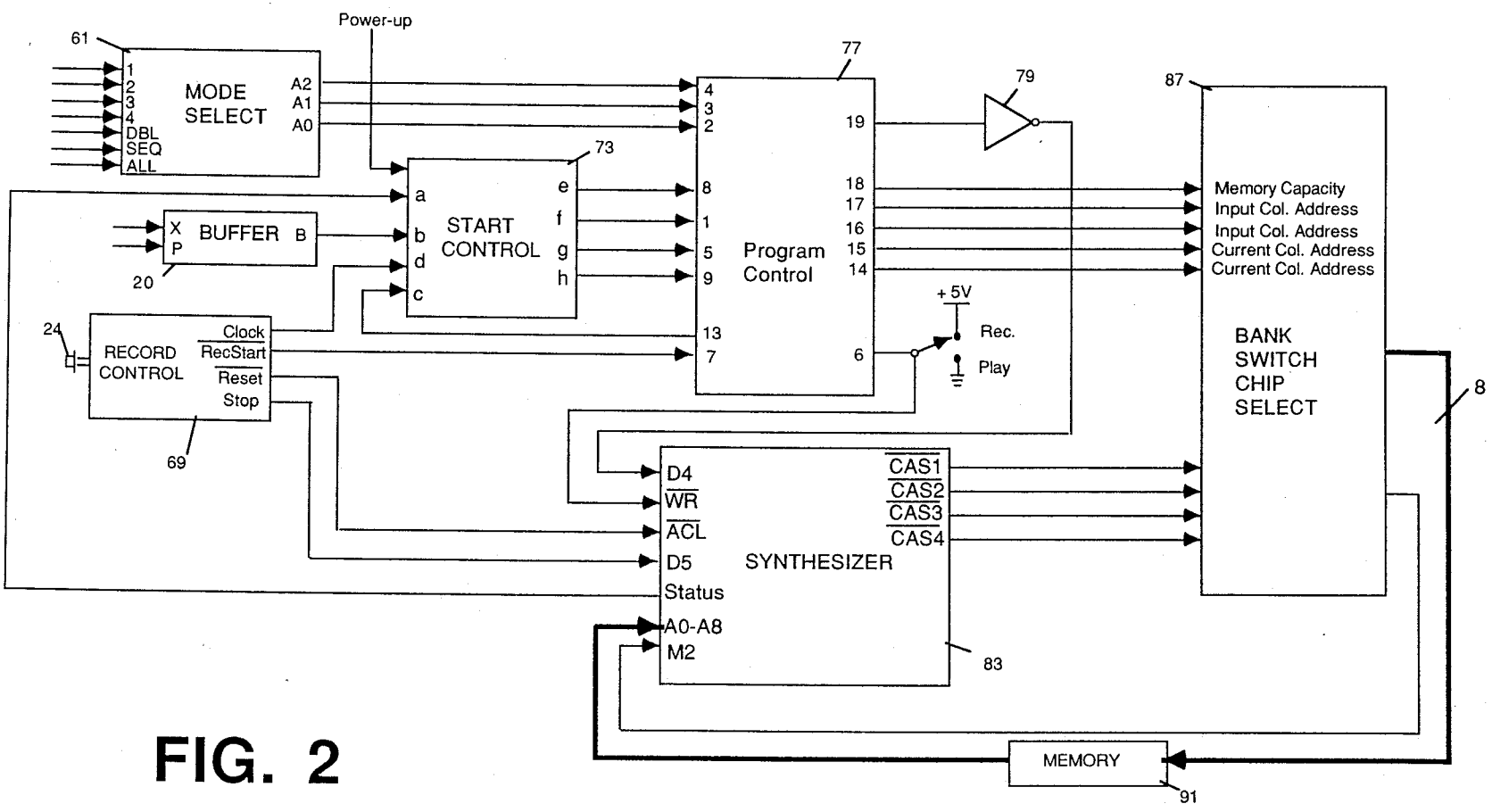
FIG. 2 is a detailed block diagram of record and play switch activator circuit 21, function selector circuit 23 and voice recorder and reproducer circuit 25.

Referring to FIG. 2, mode select 61 generally corresponds to function selector circuit 23; record control 69 and start control 73 generally correspond to recording play switch activator 21. The remaining elements namely program control 77, inverter 79, synthesizer 83, bank switch chips select 87 and memory 91 generally correspond to voice recorder and reproducer 25.

Mode select 61 generates the signals A0, A1 and A2 according to the following equations:

$$A0 = DBL + 1 + \overline{2} + 3 + \overline{4} + \overline{SEQ} + \overline{ALL};$$

$$A1 = \overline{DBL} + 1 + 2 + \overline{3} + \overline{4} + \overline{SEQ} + \overline{ALL};$$

$$A2 = \overline{DBL} + 1 + 2 + 3 + 4 + \overline{SEQ} + \overline{ALL}$$

Record control 69 generates the signals Clock, Rec-Start and Reset whenever the record button 24 is depressed. The signal Stop is generated whenever the record button 24 is released.

Buffer 20 generates the signal $B = \overline{X} + \overline{P}$ where X is asserted on a signal from external trigger 17 and P is asserted by window detector 15 when movement is detected by infra-red detector 11 as described above.

Start control 73 is a logic circuit whose inputs are Process Status, Input Trigger, Restart Inhibit and Latch Clock which are referenced in FIG. 2 as a, b, c and d respectively, and Power-up. The outputs of start control 73 are the signals Restart, Latch Clock, Start and Initialize, which are referenced in FIG. 2 as e, f, g and h respectively. The outputs e, f, g and h are generated by start control 73 as follows:

$$e = a\bar{c};\ pps$$
$$f = a\bar{c} + d + bh;$$

$$g = a\bar{c} + ab;$$

$$h = \text{Power-up} + f.$$

Program control 77 is a programmable array logic device (PAL) such as a PAL16R4 available from Texas Instruments which has been programmed as shown in appendix 1. The numbers associated with the inputs and outputs of program control 77 correspond to the pin outs of a PAL16R4. Program control 77 is used to control the operation of synthesizer 83 and bank switch select logic 87 as follows. Firstly, memory 91 is a random access memory (RAM) which stores one or more messages to be played back. Memory 91 may be implemented as a bank switchable DRAM wherein bank switch chip select 87 generates a signal 94 which is input M2 of synthesizer 83 and address select signals 98. Memory 91 is a set of eight 256K or 1024K by 1 bit DRAMs coupled between synthesizer 83 and bank switch chip select 87 such that if the eight chips are numbered 1, 2, 3, 4, 5, 6, 7 and 8, the following table sets forth the memory chips which are enabled by bank switch chip select 87 as a function of the output of mode select 61:

| Mode Select | A0 | A1 | A2 | Chips Enabled |
|---|---|---|---|---|
| CH1 | 1 | 1 | 1 | 1, 8 |
| CH2 | 0 | 1 | 1 | 2, 7 |
| CH3 | 1 | 0 | 1 | 3, 6 |
| CH4 | 0 | 0 | 1 | 4, 5 |
| DBL | 1 | 0 | 0 | 5, 6, 7, 8 |
| SEQ | 0 | 0 | 0 | 1–8, in steps |
| ALL | 0 | 1 | 0 | 1–8, continuous |

Specific implementation details of bank switch chip select 87 should be apparent to a person having ordinary skill in the relevant art based upon the description of the inputs and outputs described herein.

Synthesizer 83 is a standard speech synthesis circuit such as a T6668 available from Toshiba. Although not shown in FIG. 2, synthesizer 83 includes MIC IN for receiving input from automatic gain control 33 which is recorded in memory 91 and the signal MIC OUT which is the output signal for audio amplifier 35. Also not shown are the signals between synthesizer 83 and memory 91 for controlling the reading from and writing to the memory namely DOut, DIn, $\overline{RAS}$ and WE. Again, the circuit details regarding the use of these signals will be apparent to persons having ordinary skill in the relevant art based upon the description of the operation of the synthesizer provided herein and the data sheet provided by the manufacturer.

RECORD MODE:MIC IN is enabled and audio recording takes place from microphone 27 or from line input 29 when record button 24 is depressed and switch 26 is in the record position. Recording is stopped by releasing record button 24 causing record control 69 to output the Stop pulse to synthesizer 83 input D5. Recording functions are also disabled automatically by synthesizer 83 whenever recording time exceeds preprogrammed limits. Specifically, the synthesizer 83 signal Status is asserted when an internal program counter reaches a maximum which is determined by the capacity of memory 91. One of four channels may be recorded at a time as determined by the position of switch 22.

PLAYBACK MODE: Playback mode is initiated by causing a line 93 to go to logic 0 by placing switch 26 in the play position. Line 93, which is input to the $\overline{WR}$ input of synthesizer 83 causes the signal Status to go low. Message data is output from pin 19 of synthesizer 83 to audio amplifier 35, and when transmission is complete, the signal Status returns to the logic high state. These events are repeated for each message to be annunciated from channel DBL or from channels 1, 2, 3, or 4.

Messages in the numbered channels can also be annunciated as a continuous string started by a single trigger or they can be annunciated in sequence, one message per trigger. The latter mode is designated as SEQ and differs from single message repetition triggering by utilizing the Status signal and the signals A0, A1 and A2 trough program control 77 to access memory 91 as described above. This process is repeated for three subsequent valid triggers i.e., the Status signal, and may be continued indefinitely since the selection of RAM 91 addresses for the four channels advance and are recirculated routinely. Retriggering in the ALL mode is necessary to provide a continuous string of annunciated messages. The string of announcements ends when the current address on program control 77 lines 16 and 17 does not match the address on program control lines 14 and 15.

Immediately after recording the four numbered channels; if the ALL mode is selected for playback, then the first message to be annunciated will be the last message recorded. If this message is on channel 4 then only this message will be annunciated on the first trigger. A second trigger will cause all four messages to be announced. If channel 2 was the last one to be recorded, then channels 2, 3 and 4 will be annunciated as a string on the first trigger. A second trigger will, as before, cause all four messages to be annunciated. Subsequent triggers in both cases will cause all four of the recorded messages to be annunciated in order. This phenomena occurs because there is no program address counter to be reset when switching from record to play mode, but a program address counter can be added to the invented circuit to correct this phenomena, if desired, without departing from the spirit and scope of the invention.

APPENDIX I

```
08F1:2030                                   31 31 31 31   ........ 1111
08F1:2040  31 31 31 31 31 31 31 31-31 31 31 31 31 31 31 31   1111111111111111
08F1:2050  31 31 31 31 31 31 31 31-30 31 31 31 0D 0A 31 31   11111111101111..11
08F1:2060  31 31 31 31 31 31 31 31-31 31 30 31 31 31 31 30   1111111111011110
08F1:2070  31 31 31 31 31 31 31 31-31 31 31 31 31 31 0D 0A   1111111111111..
08F1:2080  31 31 31 31 31 31 31 31-30 31 31 31 31 31 31 31   1111111101111111
08F1:2090  30 31 31 31 30 31 31 31-31 31 31 31 31 31 31 31   0111011111111111
08F1:20A0  0D 0A 31 30 31 31 30 31-31 31 31 30 31 31 31 31   ..1011011110111
08F1:20B0  30 31 31 31 31 31 31 31-31 31 30 31 31 31 31 31   0111111111011111
08F1:20C0  31 31 0D 0A 31 30 31 31-30 31 31 31 31 30 30 31   11..10110111001
08F1:20D0  31 31 31 30 31 31 31 31-31 31 31 31 30 31 31 31   1110111111110111
08F1:20E0  31 31 31 31 0D 0A 30 31-31 31 31 30 31 31 31 30   1111..0111101110
08F1:20F0  31 31 31 31 31 31 30 31-31 31 30 31 31 31 31 31   1111110111011111
08F1:2100  31 31 31 31 31 31 0D 0A-30 30 30 30 30 30 30 30   111111..00000000
08F1:2110  30 30 30 30 30 30 30 30-30 30 30 30 30 30 30 30   0000000000000000
08F1:2120  30 30 30 30 30 30 30 30-0D 0A 30 30 30 30 30 30   00000000..000000
08F1:2130  30 30 30 30 30 30 30 30-30 30 30 30 30 30 30 30   0000000000000000
08F1:2140  30 30 30 30 30 30 30 30-30 30 0D 0A 31 31 31 31   0000000000..1111
08F1:2150  31 31 31 31 31 31 31 31-31 31 31 31 31 31 31 31   1111111111111111
08F1:2160  31 31 31 31 31 31 31 31-30 31 31 31 0D 0A 31 31   11111111101111..11
08F1:2170  31 31 31 31 31 31 30 31-31 31 31 31 31 31 31 31   1111110111111111
-

08F1:2180  31 31 31 31 31 31 31 31-31 31 31 31 31 31 0D 0A   1111111111111..
08F1:2190  31 30 31 31 31 31 31 31-31 30 31 31 31 31 31 31   1011111110111111
08F1:21A0  31 31 31 31 31 31 31 31-31 31 31 31 31 31 31 31   1111111111111111
08F1:21B0  0D 0A 30 30 30 30 30 30-30 30 30 30 30 30 30 30   ..0000000000000
08F1:21C0  30 30 30 30 30 30 30 30-30 30 30 30 30 30 30 30   0000000000000000
08F1:21D0  30 30 0D 0A 30 30 30 30-30 30 30 30 30 30 30 30   00..00000000000
08F1:21E0  30 30 30 30 30 30 30 30-30 30 30 30 30 30 30 30   0000000000000000
08F1:21F0  30 30 30 30 0D 0A 30 30-30 30 30 30 30 30 30 30   0000..0000000000
08F1:2200  30 30 30 30 30 30 30 30-30 30 30 30 30 30 30 30   0000000000000000
08F1:2210  30 30 30 30 30 30 0D 0A-30 30 30 30 30 30 30 30   000000..00000000
08F1:2220  30 30 30 30 30 30 30 30-30 30 30 30 30 30 30 30   0000000000000000
08F1:2230  30 30 30 30 30 30 30 30-0D 0A 30 30 30 30 30 30   00000000..000000
08F1:2240  30 30 30 30 30 30 30 30-30 30 30 30 30 30 30 30   0000000000000000
08F1:2250  30 30 30 30 30 30 30 30-30 30 0D 0A 30 31 31 31   0000000000..0111
08F1:2260  31 31 31 31 31 31 31 31-31 31 31 31 31 31 31 31   1111111111111111
08F1:2270  31 31 31 31 31 31 30 31-30 31 31 31 0D 0A 31 30   111111010111..10
08F1:2280  31 31 31 31 31 31 31 30-30 31 31 31 30 31 31 30   1111111001110110
08F1:2290  31 31 31 31 31 31 31 31-31 31 30 31 30 31 0D 0A   11111111110101..
08F1:22A0  31 30 31 31 31 31 31 31-31 30 30 31 31 31 31 30   1011111110011110
08F1:22B0  31 30 31 31 31 31 31 31-31 31 31 31 30 31 30 31   1011111111110101
08F1:22C0  0D 0A 31 30 31 31 31 31-31 31 31 30 31 31 31 31   ..1011111101111
08F1:22D0  31 31 31 30 31 31 31 31-31 31 31 31 31 31 31 31   1110111111111111
08F1:22E0  31 30 0D 0A 30 30 30 30-30 30 30 30 30 30 30 30   10..000000000000
08F1:22F0  30 30 30 30 30 30 30 30-30 30 30 30 30 30 30 30   0000000000000000
-

08F1:2300  30 30 30 30 0D 0A 30 30-30 30 30 30 30 30 30 30   0000..0000000000
08F1:2310  30 30 30 30 30 30 30 30-30 30 30 30 30 30 30 30   0000000000000000
08F1:2320  30 30 30 30 30 30 0D 0A-30 30 30 30 30 30 30 30   000000..00000000
08F1:2330  30 30 30 30 30 30 30 30-30 30 30 30 30 30 30 30   0000000000000000
08F1:2340  30 30 30 30 30 30 30 30-0D 0A 30 30 30 30 30 30   00000000..000000
08F1:2350  30 30 30 30 30 30 30 30-30 30 30 30 30 30 30 30   0000000000000000
08F1:2360  30 30 30 30 30 30 30 30-30 30 0D 0A 31 31 31 31   0000000000..1111
08F1:2370  30 31 31 31 31 31 31 31-31 31 31 31 31 31 31 31   0111111111111111
08F1:2380  31 31 31 31 31 31 30 31-30 31 31 31 0D 0A 31 30   111111010111..10
08F1:2390  31 31 31 31 31 31 31 30-30 31 31 31 30 31 31 30   1111111001110110
```

```
08F1:23A0  31 31 31 31 31 31 31 31-31 31 30 31 30 31 0D 0A   1111111111010 1..
08F1:23B0  31 30 31 31 31 31 31 31-31 30 31 30 31 31 31 30   1011111110101110
08F1:23C0  31 30 31 31 31 31 31 31-31 31 31 31 30 31 30 31   1011111111110101
08F1:23D0  0D 0A 31 30 31 31 31 31-31 31 31 30 31 31 31 31   ..1011111110111 1
08F1:23E0  31 31 31 30 31 31 31 31-31 31 31 31 31 31 31 31   1110111111111111
08F1:23F0  31 30 0D 0A 30 30 30 30-30 30 30 30 30 30 30 30   10..000000000000
08F1:2400  30 30 30 30 30 30 30 30-30 30 30 30 30 30 30 30   0000000000000000
08F1:2410  30 30 30 30 0D 0A 30 30-30 30 30 30 30 30 30 30   0000..0000000000
08F1:2420  30 30 30 30 30 30 30 30-30 30 30 30 30 30 30 30   0000000000000000
08F1:2430  30 30 30 30 30 30 0D 0A-30 30 30 30 30 30 30 30   .000000..00000000
08F1:2440  30 30 30 30 30 30 30 30-30 30 30 30 30 30 30 30   0000000000000000
08F1:2450  30 30 30 30 30 30 30 30-0D 0A 30 30 30 30 30 30   00000000..000000
08F1:2460  30 30 30 30 30 30 30 30-30 30 30 30 30 30 30 30   0000000000000000
08F1:2470  30 30 30 30 30 30 30 30-30 30 0D 0A 30 31 31 31   0000000000..0111
-

08F1:2480  31 31 31 31 30 31 31 31-31 31 31 31 30 31 31 31   1111011111110111
08F1:2490  31 31 31 31 31 31 31 31-30 31 31 30 0D 0A 31 31   111111110110..11
08F1:24A0  31 31 31 31 31 31 31 30-31 31 31 31 31 31 31 31   1111111011111111
08F1:24B0  31 30 31 31 31 31 31 31-31 31 30 31 31 31 0D 0A   1011111111110111..
08F1:24C0  31 31 31 31 31 31 31 31-31 31 31 31 31 31 31 31   1111111111111111
08F1:24D0  31 31 31 30 31 31 31 31-31 31 31 31 30 31 30 31   1110111111110101
08F1:24E0  0D 0A 31 31 31 31 31 31-31 31 31 31 31 31 31 31   ..1111111111111 1
08F1:24F0  31 31 31 30 31 30 31 31-31 31 31 31 31 31 30 31   1110101111111101
08F1:2500  31 31 0D 0A 30 30 30 30-30 30 30 30 30 30 30 30   11..000000000000
08F1:2510  30 30 30 30 30 30 30 30-30 30 30 30 30 30 30 30   0000000000000000
08F1:2520  30 30 30 30 0D 0A 30 30-30 30 30 30 30 30 30 30   0000..0000000000
08F1:2530  30 30 30 30 30 30 30 30-30 30 30 30 30 30 30 30   0000000000000000
08F1:2540  30 30 30 30 30 30 0D 0A-30 30 30 30 30 30 30 30   000000..00000000
08F1:2550  30 30 30 30 30 30 30 30-30 30 30 30 30 30 30 30   0000000000000000
08F1:2560  30 30 30 30 30 30 30 30-0D 0A 30 30 30 30 30 30   00000000..000000
08F1:2570  30 30 30 30 30 30 30 30-30 30 30 30 30 30 30 30   0000000000000000
08F1:2580  30 30 30 30 30 30 30 30-30 30 0D 0A 31 31 31 31   0000000000..1111
08F1:2590  30 31 31 31 30 31 31 31-31 31 31 31 30 31 31 31   0111011111110111
08F1:25A0  31 31 31 31 31 31 31 31-30 31 31 30 0D 0A 31 31   111111110110..11
08F1:25B0  31 31 31 31 31 31 31 30-31 31 31 31 31 31 31 31   1111111011111111
08F1:25C0  31 31 31 31 31 30 31 31-31 31 30 31 31 31 0D 0A   11111011110111..
08F1:25D0  31 31 31 31 31 31 31 31-31 31 31 31 31 31 31 31   1111111111111111
08F1:25E0  31 31 31 31 31 31 31 30-31 31 31 31 30 31 30 31   1111111011110101
08F1:25F0  0D 0A 31 31 31 31 31 31-31 31 31 31 31 31 31 31   ..1111111111111 1
-

08F1:2600  31 31 31 30 31 31 31 31-31 30 31 31 31 31 30 31   1110111110111101
08F1:2610  31 31 0D 0A 30 30 30 30-30 30 30 30 30 30 30 30   11..000000000000
08F1:2620  30 30 30 30 30 30 30 30-30 30 30 30 30 30 30 30   0000000000000000
08F1:2630  30 30 30 30 0D 0A 30 30-30 30 30 30 30 30 30 30   0000..0000000000
08F1:2640  30 30 30 30 30 30 30 30-30 30 30 30 30 30 30 30   0000000000000000
08F1:2650  30 30 30 30 30 30 0D 0A-30 30 30 30 30 30 30 30   000000..00000000
08F1:2660  30 30 30 30 30 30 30 30-30 30 30 30 30 30 30 30   0000000000000000
08F1:2670  30 30 30 30 30 30 30 30-0D 0A 30 30 30 30 30 30   00000000..000000
08F1:2680  30 30 30 30 30 30 30 30-30 30 30 30 30 30 30 30   0000000000000000
08F1:2690  30 30 30 30 30 30 30 30-30 30 0D 0A 31 31 31 31   0000000000..1111
08F1:26A0  31 31 31 31 31 31 31 31-31 31 31 31 31 31 31 31   1111111111111111
08F1:26B0  31 31 31 31 31 31 31 31-30 31 31 31 0D 0A 31 30   111111110111..10
08F1:26C0  31 31 31 31 31 31 31 30-31 31 31 31 31 31 31 31   1111111011111111
08F1:26D0  31 31 31 31 31 31 31 31-31 31 31 31 31 31 0D 0A   111111111111111..
08F1:26E0  30 30 30 30 30 30 30 30-30 30 30 30 30 30 30 30   0000000000000000
08F1:26F0  30 30 30 30 30 30 30 30-30 30 30 30 30 30 30 30   0000000000000000
08F1:2700  0D 0A 30 30 30 30 30 30-30 30 30 30 30 30 30 30   ..00000000000000
08F1:2710  30 30 30 30 30 30 30 30-30 30 30 30 30 30 30 30   0000000000000000
08F1:2720  30 30 0D 0A 30 30 30 30-30 30 30 30 30 30 30 30   00..000000000000
```

```
08F1:2730  30 30 30 30 30 30 30 30-30 30 30 30 30 30 30 30   0000000000000000
08F1:2740  30 30 30 30 0D 0A 30 30-30 30 30 30 30 30 30 30   0000..0000000000
08F1:2750  30 30 30 30 30 30 30 30-30 30 30 30 30 30 30 30   0000000000000000
08F1:2760  30 30 30 30 30 30 0D 0A-30 30 30 30 30 30 30 30   000000..00000000
08F1:2770  30 30 30 30 30 30 30 30-30 30 30 30 30 30 30 30   0000000000000000
08F1:2780  30 30 30 30 30 30 30 30-0D 0A 30 30 30 30 30 30   00000000..000000
08F1:2790  30 30 30 30 30 30 30 30-30 30 30 30 30 30 30 30   0000000000000000
08F1:27A0  30 30 30 30 30 30 30 30-30 30 0D 0A 31 31 31 31   0000000000..1111
08F1:27B0  31 31 31 31 31 31 31 31-31 31 31 31 31 31 31 31   1111111111111111
08F1:27C0  31 31 31 31 31 31 31 31-30 31 31 31 0D 0A 31 31   1111111110111..11
08F1:27D0  31 31 31 31 31 31 31 31-31 30 31 31 31 30 31 30   1111111110111010
08F1:27E0  31 30 31 31 31 30 31 31-31 31 31 31 31 31 0D 0A   1011101111111..
08F1:27F0  31 31 31 31 31 31 31 31-31 31 31 30 31 31 30 31   1111111111101101
08F1:2800  31 30 31 30 31 31 30 31-31 31 31 31 31 31 31 31   1010110111111111
08F1:2810  0D 0A 31 31 31 31 31 31-31 31 31 31 30 31 31 31   ..1111111111011 1
08F1:2820  31 30 31 30 30 31 31 31-31 30 31 31 31 31 31 31   1010011110111111
08F1:2830  31 31 0D 0A 31 31 31 31-31 31 31 31 31 31 30 31   11..111111111101
08F1:2840  31 31 30 31 31 30 30 31-31 31 30 31 31 31 31 31   1101100111011111
08F1:2850  31 31 31 31 0D 0A 31 31-31 31 31 30 31 31 31 31   1111..1111101111
08F1:2860  31 31 31 31 31 31 30 31-31 31 31 31 31 30 31 31   1111110111111011
08F1:2870  31 31 31 31 31 31 0D 0A-31 30 31 31 31 30 31 31   111111..10111011
08F1:2880  31 31 31 31 31 31 31 31-30 31 31 30 31 31 30 31   1111111101101101
08F1:2890  31 31 31 31 31 31 31 31-0D 0A 31 30 31 31 30 31   11111111..101101
08F1:28A0  31 31 31 31 31 31 31 31-31 31 30 31 31 30 31 31   1111111111011011
08F1:28B0  31 30 31 31 31 31 31 31-31 31 0D 0A 2A 1A FF FF   1011111111..*...
```

I claim:

1. An integral and manually transportable apparatus for detecting the presence of persons within a predetermined distance and generating a predetermined audio message upon said detection, said apparatus comprising:

(a) sensor means for generating a signal indicating the presence of at least one person within a dynamically variable predetermined distance, wherein said predetermined distance may be dynamically varied by an operator;

(b) logic circuit means coupled to said sensor means for generating at least one control signal for starting and stopping the playback of a prerecorded message; and (c) playback means for storing said prerecorded message and playing back said message upon receipt of said at least one control signal.

2. The apparatus defined by claim 1 further comprising recording means for dynamically changing the prerecorded message.

3. The apparatus defined by claim 2 wherein said recording means comprises:

(a) a microphone for converting voice information to an electrical signal coupled to an automatic gain control means for controlling the amplitude of said electrical signal;

(b) voice synthesizer means coupled to said automatic gain control means for converting said amplitude controlled electrical signal to a digital signal representing said voice information; and (c) a random access memory for storing said digital signal coupled to said voice synthesizer means and said playback means.

4. The apparatus defined by claim 2 wherein said recording means comprises:

(a) an audio input connector for coupling to an external source of voice information which has been connected to an electrical signal, said connector coupled to an automatic gain control means for controlling the amplitude of said electrical signal;

(b) voice synthesizer means coupled to said automatic gain control means for converting said amplitude controlled electrical signal to a digital signal representing said voice information; and (c) a random access memory for storing said digital signal coupled to said voice synthesizer means and said playback means.

5. The apparatus defined by claim 1 wherein said sensor means comprises a passive infra-red detector with a single lithium tantalate sensing element.

6. The apparatus defined by claim 1 wherein said playback means includes an amplifier and an electronic switch coupled to said logic means and said electronic switch for applying power supplied to said amplifier only during periods of time when said playback means is playing back said prerecorded message.

7. The apparatus defined by claim 1 wherein said playback means comprises a cartridge including a read only memory within which said prerecorded message is stored as data and a speech synthesizer for converting said data to a signal capable of being used by a speaker means for producing an audible signal.

8. The apparatus defined by claim 1 further comprising means for receiving an external trigger and generating said at least one control signal upon receipt of said external trigger.

9. The apparatus defined by claim 1 wherein said prerecorded message comprises a plurality of segments each of which is stored in a separate channel and said playback means includes a switch for selecting at least one of said channels to use for playback.

10. An integral and manually transportable apparatus for detecting the presence of persons within a predetermined distance and generating a predetermined visual message upon said detection, said apparatus comprising:

(a) sensor means for generating a signal indicating the presence of at least one person within a dynamically variable predetermined distance, wherein said predetermined distance may be dynamically varied by an operator;

(b) logic circuit means coupled to said sensor means for generating at least one control signal; and (c) display means coupled to said logic circuit means for displaying a visual image upon receipt of said at least one control signal.

11. The apparatus defined by claim 10 wherein said sensor means comprises a passive infra-red detector with a single lithium tantalate sensing element.

12. The apparatus defined by claim 10 further comprising recording means for dynamically changing the prerecorded message.

13. The apparatus defined by claim 12 wherein said recording means comprises:

(a) a microphone for converting voice information to an electrical signal coupled to automatic gain control means for controlling the amplitude of said electrical signal;

(b) voice synthesizer means coupled to said automatic gain control means for converting said amplitude controlled electrical signal to a digital signal representing said voice information; and (c) a random access memory for storing said digital signal coupled to said voice synthesizer means and said playback means.

14. The apparatus defined by claim 10 further comprising:

(a) logic circuit means coupled to said sensor means for generating at least one control signal for starting and stopping the playback of a prerecorded message; and (b) playback means for storing said prerecorded message and playing back said message upon receipt of said at least one control signal.

15. The apparatus define by claim 14 wherein said playback means includes an amplifier and an electronic switch coupled to said logic means, said electronic switch for applying power supplied to said amplifier only during periods of time when said playback means is playing back said prerecorded message.

16. The apparatus defined by claim 14 wherein said playback means comprises a cartridge including a read only memory within which said prerecorded message is stored as data and a speech synthesizer for converting said data to a signal capable of being used by a speaker means for producing an audible signal.

17. The apparatus defined by claim 10 wherein said display means comprises a transparency viewer.

* * * * *

UNITED STATES PATENT AND TRADEMARK OFFICE

CERTIFICATE OF CORRECTION

PATENT NO. : 4,912,457

DATED : 3/27/90

INVENTOR(S) : Ladd

It is certified that error appears in the above-identified patent and that said Letters Patent is hereby corrected as shown below:

Col. 05, line 11 after "ac;" delete "pps"

Signed and Sealed this

Fourth Day of May, 1993

Michael K. Kirk

MICHAEL K. KIRK

*Acting Commissioner of Patents and Trademarks*

*Attest:*

*Attesting Officer*